US010385497B2

(12) United States Patent
Choi

(10) Patent No.: US 10,385,497 B2
(45) Date of Patent: Aug. 20, 2019

(54) METHOD OF CONTROLLING WASHING MACHINE

(71) Applicant: LG ELECTRONICS INC., Seoul (KR)

(72) Inventor: Moonsuk Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 15/261,027

(22) Filed: Sep. 9, 2016

(65) Prior Publication Data

US 2017/0073873 A1 Mar. 16, 2017

(30) Foreign Application Priority Data

Sep. 10, 2015 (KR) ..... 10-2015-0128085

(51) Int. Cl.
*D06F 37/20* (2006.01)
*D06F 37/30* (2006.01)
(Continued)

(52) U.S. Cl.
CPC ..... *D06F 37/203* (2013.01); *D06F 35/006* (2013.01); *D06F 37/304* (2013.01);
(Continued)

(58) Field of Classification Search
CPC .... D06F 37/203; D06F 39/002; D06F 37/304; D06F 35/007; D06F 35/006
(Continued)

(56) References Cited

U.S. PATENT DOCUMENTS

2011/0247146 A1* 10/2011 Miller ..... D06F 35/007 8/137
2013/0119909 A1* 5/2013 Clemons ..... D06F 37/203 318/434

(Continued)

FOREIGN PATENT DOCUMENTS

KR 10-1074702 B1 10/2011
KR 10-1203565 B1 11/2012
KR 10-1455773 B1 11/2014

*Primary Examiner* — Joseph L. Perrin
*Assistant Examiner* — Kevin G Lee
(74) *Attorney, Agent, or Firm* — Dentons US LLP

(57) ABSTRACT

Disclosed is a control method of a washing machine. The method includes accelerating an angular speed of a wash tub by rotating the wash tub in which water is stored in a washing or rinsing operation, and detecting current angular-speed values with a time gap within a preset preliminary-acceleration range, thereby calculating a preliminary angular-speed variation-value by adding absolute values of differences between the current angular-speed values detected before and after each time gap, comparing the preliminary angular-speed variation-value with a preset preliminary reference variation-value to perform fabric dispersion when the preliminary angular-speed variation-value exceeds the preliminary reference variation-value, and discharging the water and rotating the wash tub so that the angular speed of the wash tub is accelerated in a dehydration operation. The preliminary reference variation-value is preset to the preliminary angular-speed variation-value, calculated when an eccentric rotation degree of the wash tub is a preset maximum tolerance value.

12 Claims, 7 Drawing Sheets

(51) Int. Cl.
*D06F 35/00* (2006.01)
*D06F 23/04* (2006.01)
*D06F 33/02* (2006.01)

(52) U.S. Cl.
CPC ..... *D06F 23/04* (2013.01); *D06F 33/02* (2013.01); *D06F 2202/085* (2013.01); *D06F 2204/065* (2013.01); *D06F 2204/084* (2013.01)

(58) Field of Classification Search
USPC ..... 68/12.06; 8/159
See application file for complete search history.

(56) References Cited

U.S. PATENT DOCUMENTS

2015/0059416 A1* 3/2015 Naber ..... D06F 37/203 68/140
2015/0121630 A1* 5/2015 Lee ..... D06F 37/306 8/137
2016/0237610 A1* 8/2016 Kim ..... D06F 33/02

* cited by examiner (a)

(b)

METHOD OF CONTROLLING WASHING MACHINE

CROSS-REFERENCE TO RELATED APPLICATION

This application claims the priority benefit of Korean Patent Application No. 10-2015-0128085, filed on Sep. 10, 2015 in the Korean Intellectual Property Office, the disclosure of which is incorporated herein by reference.

BACKGROUND OF THE INVENTION

1. Field of the Invention

The present invention relates to a method of controlling a washing machine, and more particularly, to a method of controlling a washing machine, which reduces the eccentric rotation of a wash tub by estimating, in advance, the eccentric rotation beyond a tolerance value.

2. Description of the Related Art

In general, a washing machine is an apparatus that removes contaminants adhered to laundry via several operations including, for example, washing, dehydration, and/or drying. In the washing machine, a wash tub, in which laundry such as, for example, clothing or bedding (hereinafter referred to as "fabric") is accommodated, is rotated in a water storage tub so that contaminants adhered to the fabric are removed.

The washing machine conventionally performs, in sequence, the supply of water into the water storage tub, washing or rinsing to remove contaminants adhered to fabric via rotation of the wash tub, the drainage of water from the water storage tub, and dehydration of the fabric via high-speed rotation of the wash tub. A dehydration operation requires higher speed rotation than in a washing or rinsing operation.

However, when the fabric is collected on one side inside the wash tub in the dehydration operation, the wash tub may rotate eccentrically, thus causing excessive vibration and noise as well as collision between the wash tub and the water storage tub or between the water storage tub and a casing. In addition, the wash tub has difficulty in reaching a predetermined rotational speed required for the dehydration operation. Therefore, the Related Art 1 and the Related Art 2, described below, implement fabric dispersion by sensing the extent to which the wash tub rotates eccentrically (hereinafter, referred to as "eccentric rotation degree").

In the Related Art 1, after the water inside the water storage tub is drained, the rotation of the wash tub is accelerated in order to perform a dehydration operation, and the eccentric rotation degree of the wash tub is sensed. When the eccentric rotation degree is a preset tolerance value or less, dehydration is performed by accelerating the wash tub to a higher speed. When the eccentric rotation degree exceeds the preset tolerance value, it is judged that fabric has collected on one side inside the wash tub or that multiple pieces of fabric agglomerate together. Thus, water is again supplied into the wash tub, and the wash tub is alternately rotated in opposite directions so as to disperse the fabric, and thereafter the eccentric rotation degree is sensed while again accelerating the rotation of the wash tub.

In the Related Art 2, the rotation of the wash tub is accelerated while the water inside the water storage tub is drained in order to perform a dehydration operation, and the eccentric rotation degree of the wash tub is sensed. When the eccentric rotation degree is a preset tolerance value or less, dehydration is performed by accelerating the wash tub to a higher speed. When the eccentric rotation degree exceeds the preset tolerance value, the drainage of water from the wash tub is stopped, fabric is dispersed using the water remaining inside the wash tub, and thereafter, the eccentric rotation degree is sensed while again accelerating the rotation of the wash tub.

Related Art 1: Korean Patent Laid-open Publication No. 10-2011-0009923 (published on Jan. 31, 2011)

Related Art 2: Japanese Patent Laid-open Publication No. 2014-8313 (published on Jan. 20, 2014)

SUMMARY OF THE INVENTION

Therefore, the present invention has been made in view of the above problems, and it is an object of the present invention to provide a method of controlling a washing machine, which reduces the eccentric rotation of a wash tub by estimating, in advance, the eccentric rotation beyond a tolerance value.

In accordance with an embodiment of the present invention, the above and other objects can be accomplished by the provision of a method of controlling a washing machine, the washing machine including a water storage tub, a wash tub for accommodating fabric therein, the wash tub being rotatably installed inside the water storage tub, and a motor for rotating the wash tub, the method including accelerating an angular speed of the wash tub by rotating the wash tub in a state in which water is stored in the wash tub in a washing or rinsing operation, and detecting a plurality of current angular speed values with a time gap within a preset preliminary acceleration range, to calculate a preliminary angular speed variation value which is a sum of absolute values of differences between the current angular speed values detected before and after each time gap, comparing the preliminary angular speed variation value with a preset preliminary reference variation value so as to trigger fabric dispersion when the preliminary angular speed variation value exceeds the preliminary reference variation value, and discharging the water inside the wash tub and rotating the wash tub so that the angular speed of the wash tub is accelerated in a dehydration operation, wherein the preliminary reference variation value is preset to the preliminary angular speed variation value which is calculated when an eccentric rotation degree of the wash tub is a preset maximum tolerance value.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

The objects of the present invention to be solved are as follows.

In the Related Art 1, although water is discharged before the dehydration operation, it is necessary to again supply water into the wash tub in order to disperse fabric when the eccentric rotation degree exceeds the tolerance value in the dehydration operation. This increases the consumption of water, and lengthens the overall operation time due to the repeated water supply and discharge. A first object is to solve this problem.

In the Related Art 2, when the wash tub or a pulsator performs agitation rotation in order to disperse fabric in the state in which the amount of residual water after drainage is smaller than the amount of fabric, an overload occurs in the wash tub or pulsator that is rotating. This increases likelihood of damaging the machine. A second object is to solve this problem.

A third object is to estimate the eccentric rotation degree of a wash tub before a dehydration operation.

A fourth object is to sense the eccentric rotation degree of a wash tub without a separate vibration detection system.

Advantages, features, and methods for achieving those of embodiments may become apparent upon referring to embodiments described later in detail together with attached drawings. However, embodiments are not limited to the embodiments disclosed hereinafter, but may be embodied in different modes. The embodiments are provided for perfection of disclosure and informing a scope to persons skilled in this field of art. The present invention is defined only by the scope of the claims. The same reference numbers may refer to the same elements throughout the specification.

Figure 1:
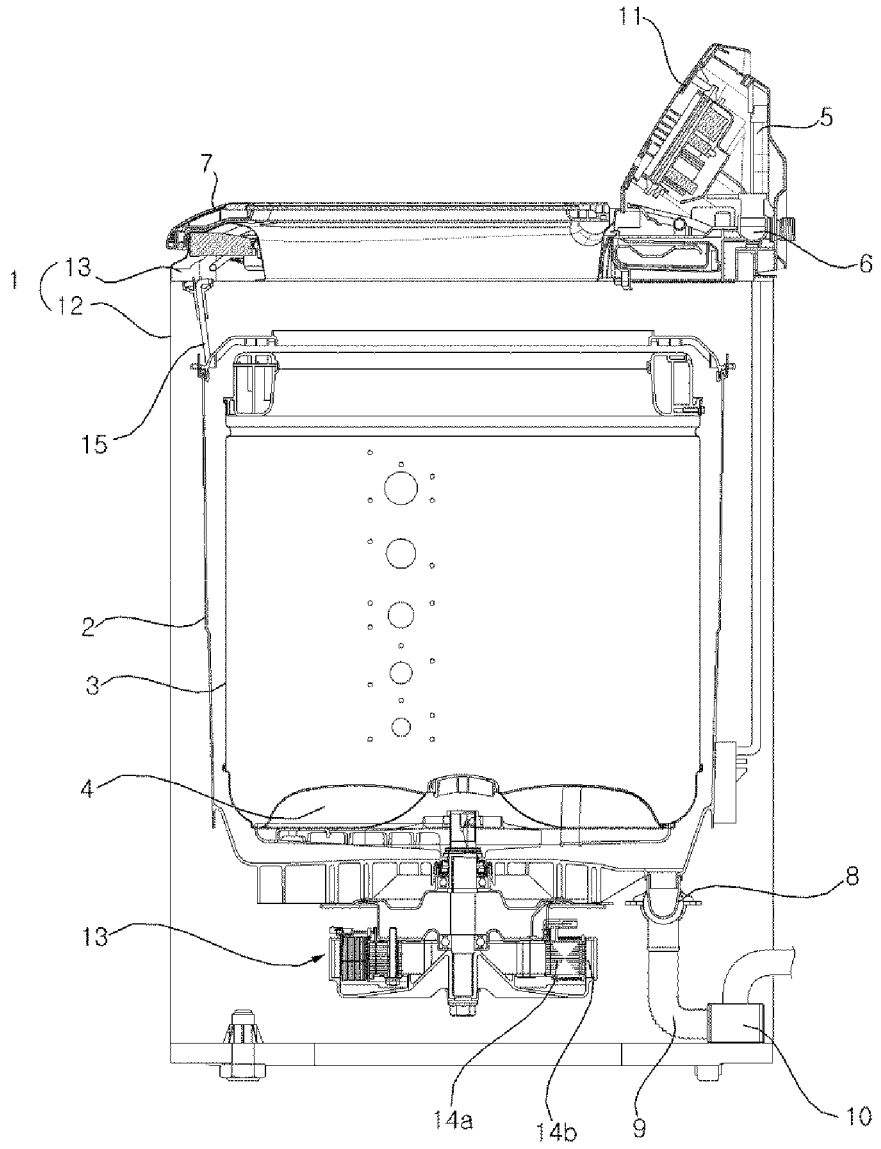
FIG. 1 is a side sectional view of a washing machine in accordance with one embodiment of the present invention.
Figure 2:
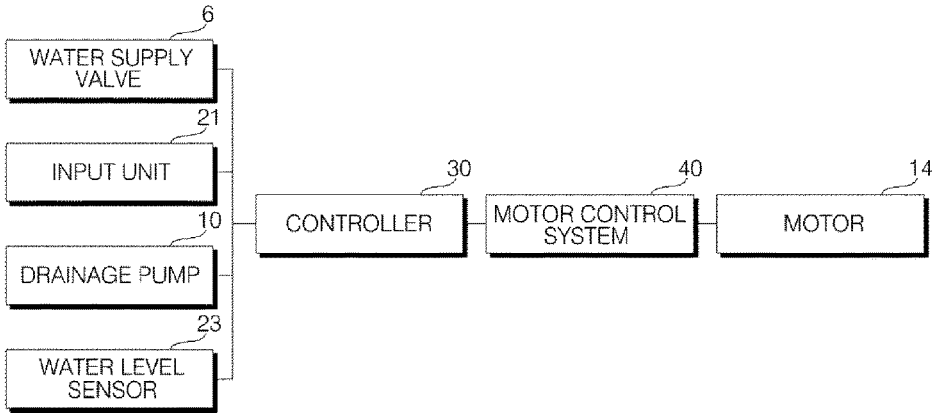
FIG. 2 is a block diagram illustrating the control relationship between major components of the washing machine illustrated in FIG. 1.

FIG. 1 is a side sectional view of a washing machine in accordance with one embodiment of the present invention. FIG. 2 is a block diagram illustrating the control relationship between major components of the washing machine illustrated in FIG. 1. Referring to FIGS. 1 and 2, the washing machine in accordance with one embodiment of the present invention may include a casing 1, a water storage tub 2 placed inside the casing 1 for accommodating wash water therein, a wash tub 3 rotatably provided inside the water storage tub 2 for accommodating laundry therein, a pulsator 4 rotatably provided inside the wash tub 3, and a motor 14 for rotating the wash tub 3 and/or the pulsator 4.

A clutch (not illustrated) may be provided to control a torque transmitted from the motor 14 to the wash tub 3 or the pulsator 4. As the clutch is appropriately operated under the control of a controller 30, only the pulsator 4 may be rotated in the state in which the wash tub 3 is stationary, or both the pulsator 4 and the wash tub 3 may be rotated.

The casing 1 internally provides a space in which various constituent elements of the washing machine, such as the water storage tub 2, the wash tub 3, and the motor 14, may be accommodated. The casing 1 may be comprised of a cabinet 12, which is open at the top thereof and provides an internal space in which the water storage tub 2 is accommodated, and a cabinet cover 13, which is disposed on the open top of the cabinet 12 and is provided at the approximate center thereof with an opening for the introduction and discharge of laundry. A door 7 configured to open or close the opening is rotatably provided on the cabinet cover 13.

The water storage tub 2 may be open at the top thereof, and may suspend from the casing 1 by a hanger 15. The upper end of the hanger 15 is rotatably connected to the cabinet cover 13, and the lower end of the hanger 15 is connected to the lower end of the water storage tub 2 by a suspension (not illustrated). The suspension serves to dampen vibration of the water storage tub 2 caused when the wash tub 3 or the pulsator 4 is rotated.

The top of the wash tub 3 is open to allow fabric to be introduced from the upper side, and the wash tub 3 is rotated about the vertical axis. The pulsator 4 may be provided on the bottom of the wash tub 3. A plurality of through-holes (not illustrated) is formed in the wash tub 3 to enable the flow of wash water between the wash tub 3 and the water storage tub 2.

The casing 1 may be provided with a control panel 11. The control panel 11 may include an input unit 21 for receiving various control commands related to the general operation of the washing machine from the user, and a display unit (not illustrated) for displaying the operational state of the washing machine. The input unit 21 may include input means, such as various operating buttons, dials, and a touchscreen, for receiving the control commands. The display unit may include, for example, diodes or an LCD/LED panel, and may take the form of a touchscreen that has the function of the input unit 21.

A water supply flow path 5 may be connected to a water source, such as a water tap, and a water supply valve 6 may be provided on the water supply flow path 5 so as to control the supply of water. When the water supply valve 6 is opened by the controller 30, the water guided through the water supply flow path 5 is supplied into the wash tub 3 and/or the water storage tub 2. In some embodiments, the water guided through the water supply flow path 5 may not be directly supplied to the wash tub 3, but may be supplied through any passage between the water storage tub 2 and the wash tub 3. Even in this case, because the water is introduced into the wash tub 3 from the water storage tub 2 through the holes formed in the wash tub 3, the level of water is the same in the water storage tub 2 and the wash tub 3 when the supply of water is completed.

The washing machine may further include a drainage flow path 9 for guiding the water discharged from the water storage tub 2, a drainage valve 8 for controlling the drainage flow path 9, and a drainage pump 10 provided on the drainage flow path 9. The drainage valve 8 may be opened under the control of the controller 30, and the water may be discharged from the water storage tub 2 when the drainage pump 10 is operated.

The motor 14 may detect and control the angular speed of the wash tub 3 and/or the position of a rotor 14*b*. The motor 14 may be a permanent magnet synchronous motor (PMSM) or a brushless DC (BLDC) electric motor, without being limited thereto. In the present embodiment, the motor 14 is limited to the BLDC electric motor.

In the entire description, "the angular speed of the wash tub 3" means the angular speed of the rotor 14*b* in the state in which the rotor 14*b* of the motor 14 and the wash tub 3 are rotated simultaneously by the clutch. As such, "the detection of the angular speed of the wash tub 3" is performed by detecting the angular speed of the rotor 14*b* in the state described above.

The motor 14 includes a stator 14*a*, around which a coil is wound, and the rotor 14*b*, which is rotated via electromagnetic interaction with the coil. In the present embodiment, the motor 14 is an outer rotor type in which the stator 14*a* is located close to a rotating shaft of the motor 14, and the rotor 14*b* having a permanent magnet is rotated outside the stator 14*a*, without being limited thereto. The motor 14 may be an inner rotor type, or an axial air-gap type.

The controller 30 controls the general operation of the washing machine. The controller 30 may control the water supply valve 6, the drainage pump 10, and a motor control system 40 illustrated in FIG. 2 as well as various other devices constituting the washing machine.

Figure 3:
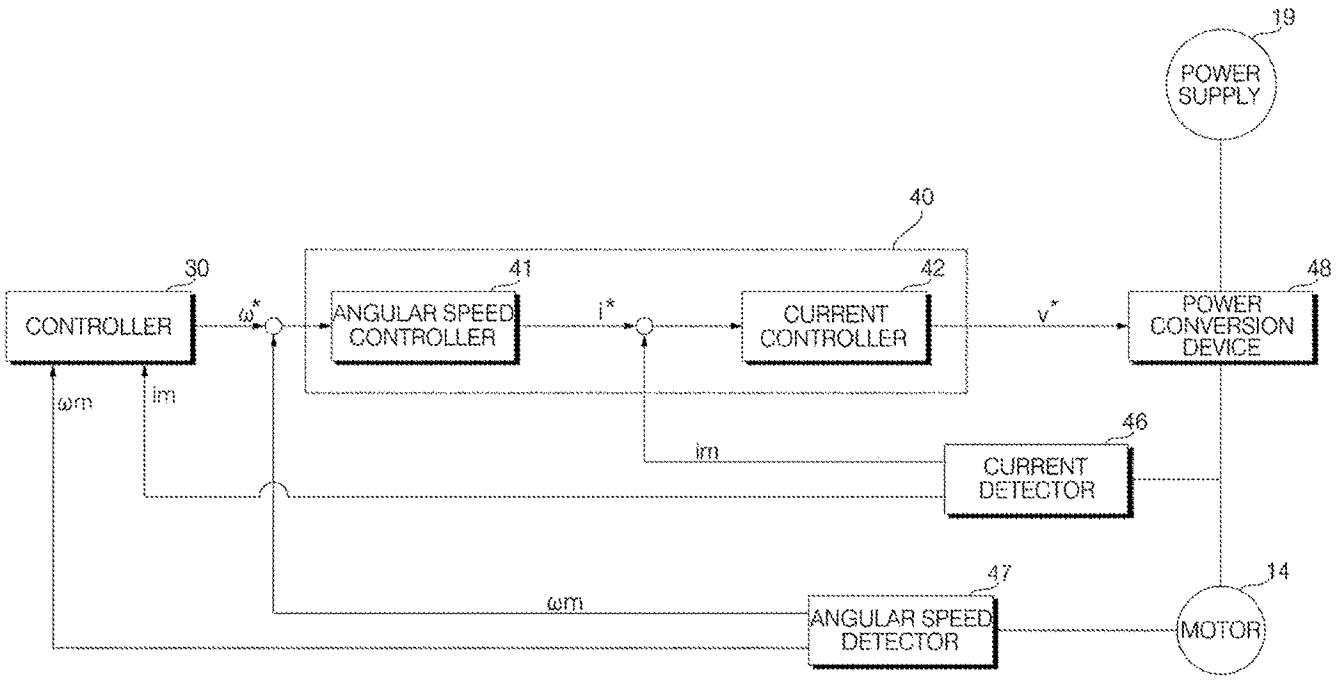
FIG. 3 is a block diagram illustrating the configuration of a motor drive system.
Figure 4:
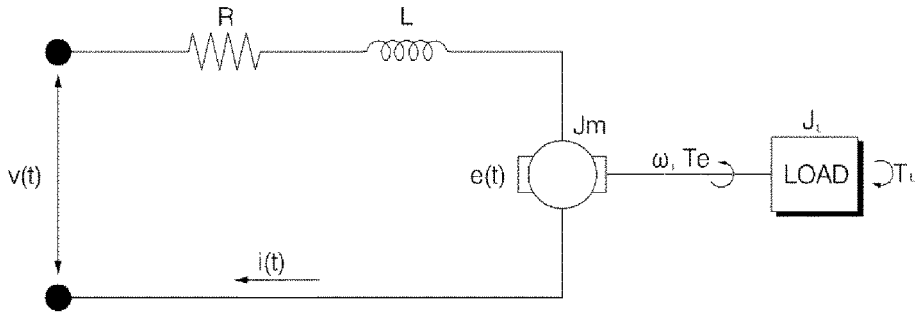
FIG. 4 is a block diagram illustrating an armature circuit for controlling a motor.

FIG. 3 is a block diagram illustrating the configuration of a motor drive system. FIG. 4 is a block diagram illustrating an armature circuit for controlling the motor. Referring to FIGS. 3 and 4, the motor control system 40 may serve to control the rotation of the motor 14, and may include an angular speed controller 41 and a current controller 42.

The angular speed controller 41 outputs a command current value i* based on a command angular speed value ω* output from the controller 30. Because the control of torque is required in order to control the position or angular speed of the rotor 14*b* of the motor 14, and because the torque is proportional to current input to an armature, the angular speed controller 41 calculates the command current value i* required for the motor 14 to rotate in response to the command angular speed value ω*, and outputs the calculated command current value i* to the current controller 42.

An angular speed detector 47 may be provided to detect the angular speed of the rotor 14*b*. An angular speed value $\omega_m$ (hereinafter, referred to as "current angular speed value") detected by the angular speed detector 47 is input to the angular speed controller 41. The angular speed controller 41 adjusts the output command current value i* via proportional-integral (PI) control based on the command angular speed value ω* output from the controller 30 and the current angular speed value $\omega_m$, thereby consequently enabling the generation of the torque required in order to set the current angular speed value $\omega_m$, of the motor 14 to the command angular speed value ω*.

The angular speed detector 47 continuously detects a plurality of current angular speed values $\omega_m$ with a time gap. The time gap may be generated when the angular speed detector 47 is configured to detect the current angular speed value $\omega_m$, whenever the rotor 14*b* is rotated by a constant rotation angle. In the present embodiment, the constant rotation angle is 15 degrees and the current angular speed value $\omega_m$, is detected by the angular speed detector 47 whenever the wash tub 3 is rotated by 15 degrees, without being limited thereto.

The current controller 42 outputs a command voltage value v* based on the command current value i* output from the angular speed controller 41. In the embodiment, the control of the motor 14 is based on the control of a voltage applied to the motor 14 via a power conversion device 48. A voltage is applied from the power conversion device 48 to the motor 14 based on the command voltage value v* output from the current controller 42.

The current controller 42 may adjust the output command voltage value v* via PI control based on the command current value i* output from the angular speed controller 41 and the current $i_m$ (hereinafter, referred to as the "current current value") detected by a current detector 46.

The power conversion device 48 converts the power output from a power supply 19 to apply a voltage to the motor 14. The power conversion device 48 may include a pulse width modulation (PWM) calculator (not illustrated) for outputting a pulse having the same magnitude as the command voltage value v* based on PWM, and an inverter (not illustrated) for directly controlling the power input to the motor 14 upon receiving a PWM signal from the PWM calculator. In some embodiments, the PWM calculator may be included in the inverter, this kind of inverter typically being referred to as a PWM inverter.

Referring to FIG. 4, the following equations emerge from the armature circuit for controlling the motor 14 and the rotational motion of a load.

Equation 1

Current-Voltage Equation of Armature Circuit:

$$v(t) = L\frac{di(t)}{dt} + R'i(t) + e(t)$$

(here, v(t): instantaneous voltage applied to armature circuit, i(t): instantaneous current of armature circuit [A]

R': resistance of armature circuit [ω]

L: inductance of armature circuit [H]

e(t): back electro-motive force (EMF) [V]).

Equation 2

Motion Equation of Load:

$$T_e = k_T\varphi_f i(t) = J\frac{d\omega(t)}{dt} + B'\omega(t) + T_L$$

(here, $T_e$: torque applied to rotor by power [Nm]

$k_T$: torque constant [Nm/WbA]

$\Phi_f$: magnetic flux of field magnet

J: inertial moment of entire system [kg·m$^2$]

ω(t): angular speed of rotor [rad/s]

B': viscous frictional coefficient [Nm/(rad/s)]

$T_L$: load torque of motor [Nm]).

Equation 3

Inertial Moment (J) Equation of Entire System $$J=J_m+J_L$$

(here, J: inertial moment of entire system [kg·m$^2$]

$J_m$: inertial moment of rotor [kg·m$^2$]

$J_L$: inertial moment of load [kg·m$^2$])

In Equation 1, the resistance R' and the inductance L are constants depending on the properties of the motor 14 and are previously determined numerical values. The instantaneous voltage v(t) is applied to the armature circuit in the same manner as the command voltage value v* output from the current controller 42. As such, the instantaneous current i(t) flowing through the armature circuit is generated. Due to, for example, the difference between Equation 1, pertaining to the theoretical model of the back electro-motive force e(t), and an actual motor, the current current value $i_m$, which is a numerical value different from the command current value i*, may be detected. When the current current value $i_m$ is different from the command current value i*, the current controller 42 changes and outputs the command voltage value v* in consideration of the difference.

In Equation 2, the torque constant $k_T$, the magnetic flux of a field magnet $\Phi_f$, and the viscous frictional coefficient B' are constant depending on the properties of the motor 14 and previously determined numerical values. The instantaneous current i(t) at a specific point in time may be acquired from the current current value $i_m$ detected at the specific point in time, and the torque $T_e$ applied to the rotor 14*b* at the specific point in time may be acquired therefrom. The angular speed ω(t) at the specific point in time may be acquired from the current angular speed value $w_m$ detected at the specific point in time, and the frictional torque Bω(t) at the specific point in time may be acquired therefrom.

In Equation 2, the inertial moment J and the load torque $T_L$ are numerical values which may change depending on the amount of fabric in the wash tub 3, the distribution state of fabric, and the amount of water. In particular, the distribution state of fabric is a numerical value that may continuously change while the wash tub 3 is rotated, and the load torque $T_L$ is a numerical value that may change depending on, for example, the angular speed ω(t) of the rotor 14*b*. Accordingly, when the angular speed ω(t) increases, the inertial moment J and the load torque $T_L$ may change as time t passes, whereby the angular acceleration $$\frac{d\omega(t)}{dt}$$

may change as time passes. In addition, a change in the angular speed ω(t) may cause the angular speed controller 41 to continuously change the command current value i*.

For this reason, it is difficult in practice for the acceleration range of the angular speed ω(t), which follows the command speed value w*, to have a constant angular acceleration $$\frac{d\omega(t)}{dt},$$

and thus the acceleration range has an angular acceleration $$\frac{d\omega(t)}{dt}$$

that continuously changes.

Figure 5:
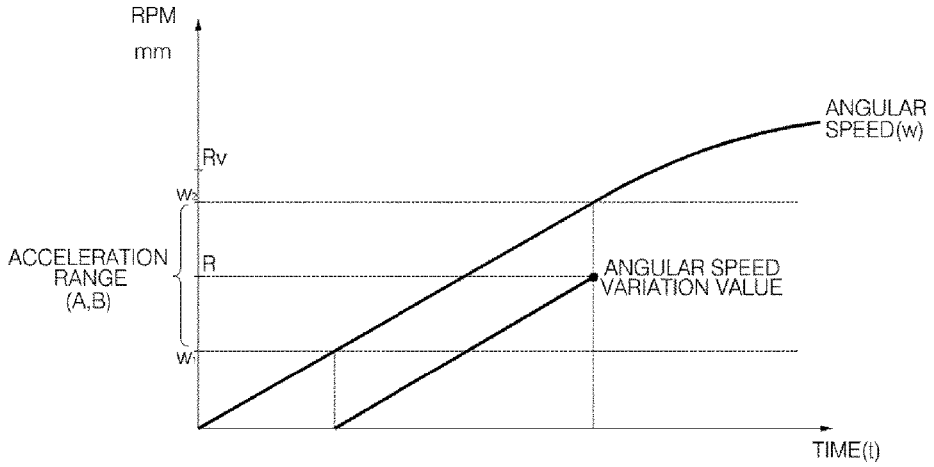
FIG. 5 is a graph illustrating the relationship between the progress of variation in the angular speed of a wash tub and an angular speed variation value within an acceleration range as time passes, FIG. 5(*a*) being a graph in the case where the eccentric rotation degree of the wash tub being small, and FIG. 5(*b*) being a graph in the case where the eccentric rotation degree of the wash tub being large.
Figure 5:
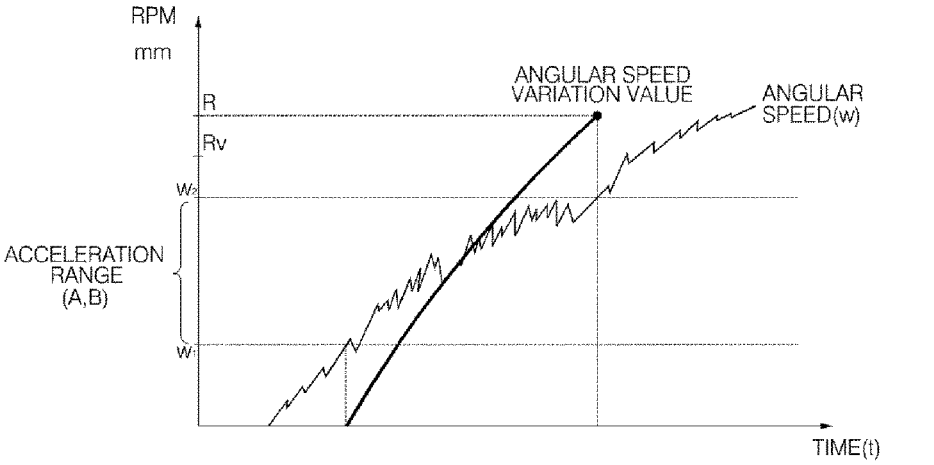

FIG. 5 is a graph illustrating the relationship between the progress of variation in the angular speed ω(t) of the wash tub 3 within an acceleration range and an angular speed variation value R (that will be described below) as time passes. FIG. 5(*a*) is a graph in the case where the eccentric rotation degree of the wash tub is small, and FIG. 5(*b*) is a graph in the case where the eccentric rotation degree of the wash tub is large. The progress of variation in the angular speed ω(t) is typically observed via experimentation. In the graph, the horizontal axis is time (t), and the vertical axis is the RPM value of the angular speed.

Referring to FIG. 5, the degree of variation in the angular acceleration $$\frac{d\omega(t)}{dt}$$

within the acceleration range increases as the eccentric rotation degree of the wash tub 3 increases. In FIG. 5(*a*), when the eccentric rotation degree of the wash tub 3 is small, the angular speed ω(t) has a relatively gentle rising curve, and the angular acceleration $$\frac{d\omega(t)}{dt}$$

changes relatively little. On the other hand, in FIG. 5(*b*), when the eccentric rotation degree of the wash tub 3 is large, the angular speed ω(t) has a somewhat wavy rising curve, and the angular acceleration $$\frac{d\omega(t)}{dt}$$

changes relatively greatly.

In order to sense the degree of variation in the angular acceleration $$\frac{d\omega(t)}{dt},$$

first, the acceleration range in which the progress of variation in the angular speed ω(t) will be analyzed is specified. The acceleration range may be a range in which the degree of variation in the angular acceleration $$\frac{d\omega(t)}{dt}$$

is clearly detected depending on the eccentric rotation degree. The acceleration range means a range in which the angular speed generally increases between a start-point angular speed ω1 and an end-point angular speed ω2.

In a dehydration operation, the wash tub 3 is accelerated in the state in which the water inside the wash tub 3 is drained. The acceleration range, specified in this case, is defined as a dehydration acceleration range B. In the present embodiment, the dehydration acceleration range B is a range from the start-point angular speed of about 90 RPM to the end-point angular speed of about 120 RPM, without being limited thereto. The eccentric rotation degree is determined by quantifying the progress of variation in the angular speed w within the dehydration acceleration range B into a dehydration angular speed variation value Rb, which will be described below.

In order to allow the eccentric rotation degree to be determined before the dehydration operation, the eccentric rotation degree is determined while the wash tub 3 is accelerated in the state in which water is stored in the wash tub 3 in a washing or rinsing operation. The acceleration range in the washing or rinsing operation is defined as a preliminary acceleration range A. In the present embodiment, the preliminary acceleration range A is a range from the start-point angular speed of about 50 RPM to the end-point angular speed of about 80 RPM, without being limited thereto. The eccentric rotation degree in the dehydration operation may be estimated with a high degree of accuracy when the eccentric rotation is determined by quantifying the progress of variation in the angular speed ω within the preliminary acceleration range A into a preliminary angular speed variation value Ra, which will be described below.

The preliminary acceleration range A and the dehydration acceleration range B correspond to each other. Here, "the two ranges A and B correspond to each other" means that these are ranges having the same progress of variation in the angular speed ω, assuming that the arrangement of fabric in the dehydration operation is the same as the arrangement of fabric in the washing or rinsing operation. When the eccentric rotation degree exceeds a tolerance value, the vibration of the wash tub 3 reaches the peak in the preliminary acceleration range A and the dehydration acceleration range B, which correspond to each other (see FIG. 6).

Figure 6:
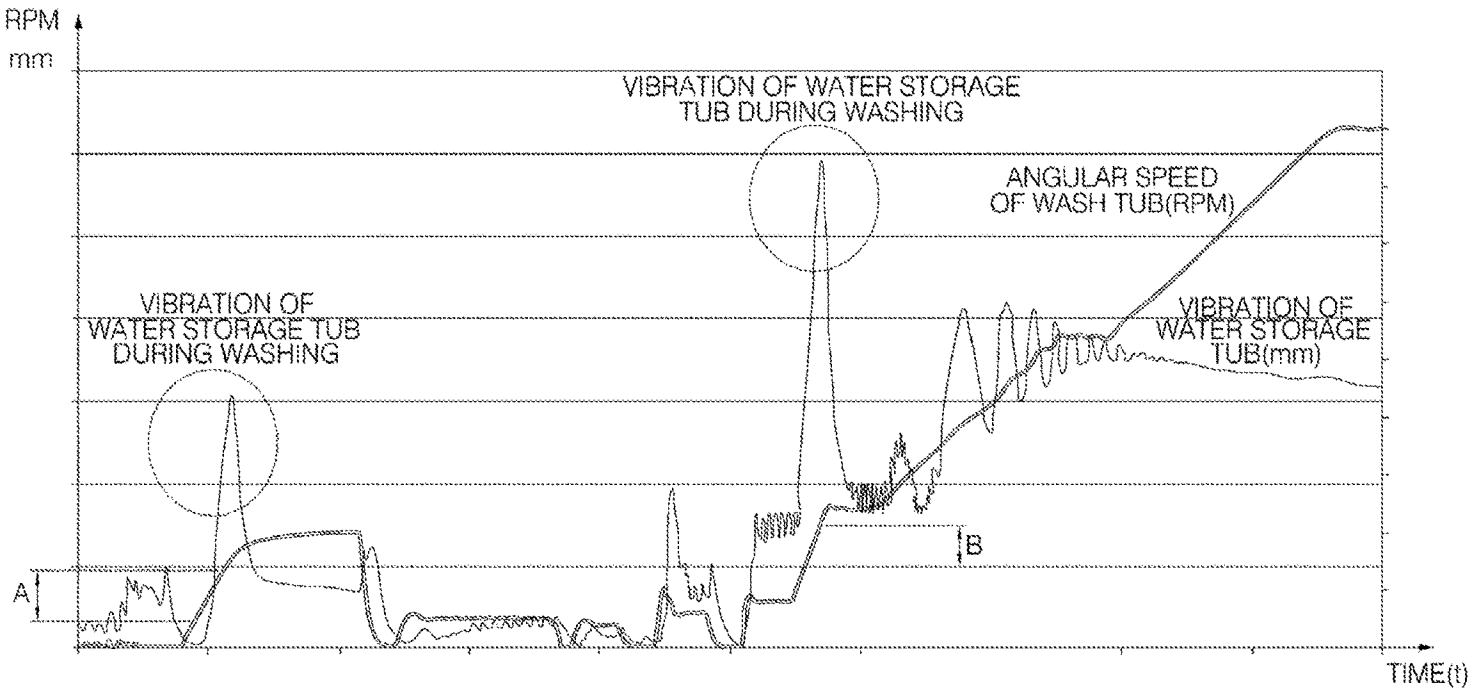
FIG. 6 is a graph illustrating the angular speed (RPM) of the wash tub and the amplitude of vibration (mm) of a water storage tub as time passes in accordance with one experimental example of the present invention.

FIG. 6 is a graph illustrating the angular speed (RPM) of the wash tub 3 and the vibration amplitude (mm) of the water storage tub 2 as time (t) passes in accordance with one experimental example of the present invention. The graph illustrates experimental data. FIG. 6 depicts a graph illustrating, along the same time axis t, the amplitude of horizontal vibration of the water storage tub 2, which is measured in units of mm by suspending a vibration detection system from the bottom of the water storage tub 2, and the angular speed of the wash tub 3, which is measured at the same time as the amplitude of horizontal vibration. In FIG. 6, the ranges in which vibration reaches the peak in the washing operation and the dehydration operation are respectively the preliminary acceleration range A and the dehydration acceleration range B, which correspond to each other.

In order to quantify the degree of variation in the angular acceleration $$\frac{d\omega(t)}{dt},$$

a numerical value, which is called the angular speed variation value R (RPM ripple), may be defined. To this end, a plurality of current angular speed values $\omega_m$ is detected with a time gap within the preset acceleration ranges A and B, so as to acquire the absolute value of the difference between the current angular speed values $\omega_m$ measured before and after each time gap. The angular speed variation value R is calculated by adding all of the absolute values acquired until the acceleration ranges A and B end.

As illustrated in FIG. 5(*b*), in the case where the eccentric rotation degree of the wash tub 3 is large, and thus the angular speed increases while fluctuating, an increasing number of absolute values have relatively large values, thus causing the angular speed variation value R to increase. For example, the angular speed variation value R is relatively small in FIG. 5(*a*) in which the degree of variation in angular speed is gentle, and the angular speed variation value R is relatively large in FIG. 5(*b*) in which the degree of variation in angular speed fluctuates. That is, the angular speed variation value R, which is acquired by quantifying the degree of variation in angular speed, increases as the eccentric rotation degree of the wash tub 3 increases.

In the washing operation, the angular speed variation value R which is acquired by accelerating the rotation of the wash tub 3 in the state in which water is stored in the wash tub 3 is defined as a preliminary angular speed variation value Ra. In addition, in the dehydration operation, the angular speed variation value R which is acquired by accelerating the rotation of the wash tub 3 in the state in which the water inside the wash tub 3 is drained is defined as a dehydration angular speed variation value Rb.

A reference variation value Rv corresponds to the maximum tolerance value of the eccentric rotation degree of the wash tub 3. That is, the reference variation value Rv is preset to the angular speed variation value R which is calculated within the acceleration ranges A and B when the wash tub 3 rotates eccentrically to the preset maximum tolerance value. When the result of comparing the angular speed variation value R with the reference variation value Rv is that the angular speed variation value R exceeds the reference variation value Rv, it is determined that the eccentric rotation degree of the wash tub 3 exceeds a tolerance value. When the result of the comparison is that the angular speed variation value R is equal to or less than the reference variation value Rv, it is determined that the eccentric rotation degree of the wash tub 3 is the tolerance value or less.

The maximum tolerance value of the eccentric rotation degree of the wash tub 3 may be preset to different values depending on, for example, product specifications or some noise standard. When the maximum tolerance value of the eccentric rotation degree of the wash tub 3 is preset to different values, the reference variation value Rv changes depending on the different values. Data regarding a plurality of maximum tolerance values of the eccentric rotation degree of the wash tub 3 and reference variation values Rv corresponding to the maximum tolerance values in a one-to-one ratio is experimentally preset, arranged in a tabular format, and is stored in the controller 30.

In addition, even if the maximum tolerance value of the eccentric rotation degree of the wash tub 3 is preset to a specific value, different reference variation values Rv may be measured depending on conditions that accelerate the angular speed of the wash tub 3. For example, even if the maximum tolerance value of the eccentric rotation degree is the same, the reference variation value Rv is different between the case where the rotation of the wash tub 3 is accelerated in the state in which water is stored in the wash tub 3 in the washing operation or the rinsing operation and the case where the rotation of the wash tub 3 is accelerated in the state in which water inside the wash tub 3 is discharged in the dehydration operation. Data regarding the reference variation values Rv, which are differently set depending on the acceleration conditions, is experimentally preset, arranged in a tabular format, and is stored in the controller 30.

In the washing operation or the rinsing operation, the reference variation value Rv which is compared with the preliminary angular speed variation value Ra is defined as a preliminary reference variation value Rva. In the dehydration operation, the reference variation value Rv in the dehydration operation which is compared with the dehydration angular speed variation value Rb is defined as a dehydration reference variation value Rvb. The preliminary reference variation value Rva and the dehydration reference variation value Rvb are preset data, and arranged in a tabular format in the controller 30. In the present embodiment, the preliminary reference variation value Rva is preset to a range from about 700 RPM to about 800 RPM, without being limited thereto.

The preliminary reference variation value Rva and the dehydration reference variation value Rvb may have different values depending on the amount of fabric inside the wash tub 3. As such, data regarding different preliminary reference variation values Rva and dehydration reference variation values Rvb depending on the sensed amount of fabric may be experimentally preset and stored in a tabular format in the controller 30. In this case, the amount of fabric inside the wash tub 3 may be sensed before the preliminary acceleration range A begins, and the preliminary reference variation value Rva and the dehydration reference variation value Rvb may be determined by the data table based on the preset maximum tolerance value of the eccentric rotation degree and the sensed amount of fabric.

In the experimentation in the present embodiment, when the preliminary angular speed variation value Ra, which is calculated by detecting the current angular speed value $\omega_m$ whenever the wash tub 3 is rotated by 15 degrees within the preliminary acceleration range A from 50 RPM to 80 RPM, exceeds the preliminary reference variation value Rva, which is preset to a range from about 700 RPM to about 800 RPM, the probability of the eccentric rotation degree of the wash tub 3 exceeding the tolerance value in the dehydration operation is about 85%. Although the probability of the eccentric rotation degree exceeding the tolerance value in the dehydration operation is not 100% because the arrangement of fabric and the amount of water change after the washing operation or the rinsing operation, the probability is very high, and thus fabric dispersion may be advantageously performed in advance.

Figure 7:
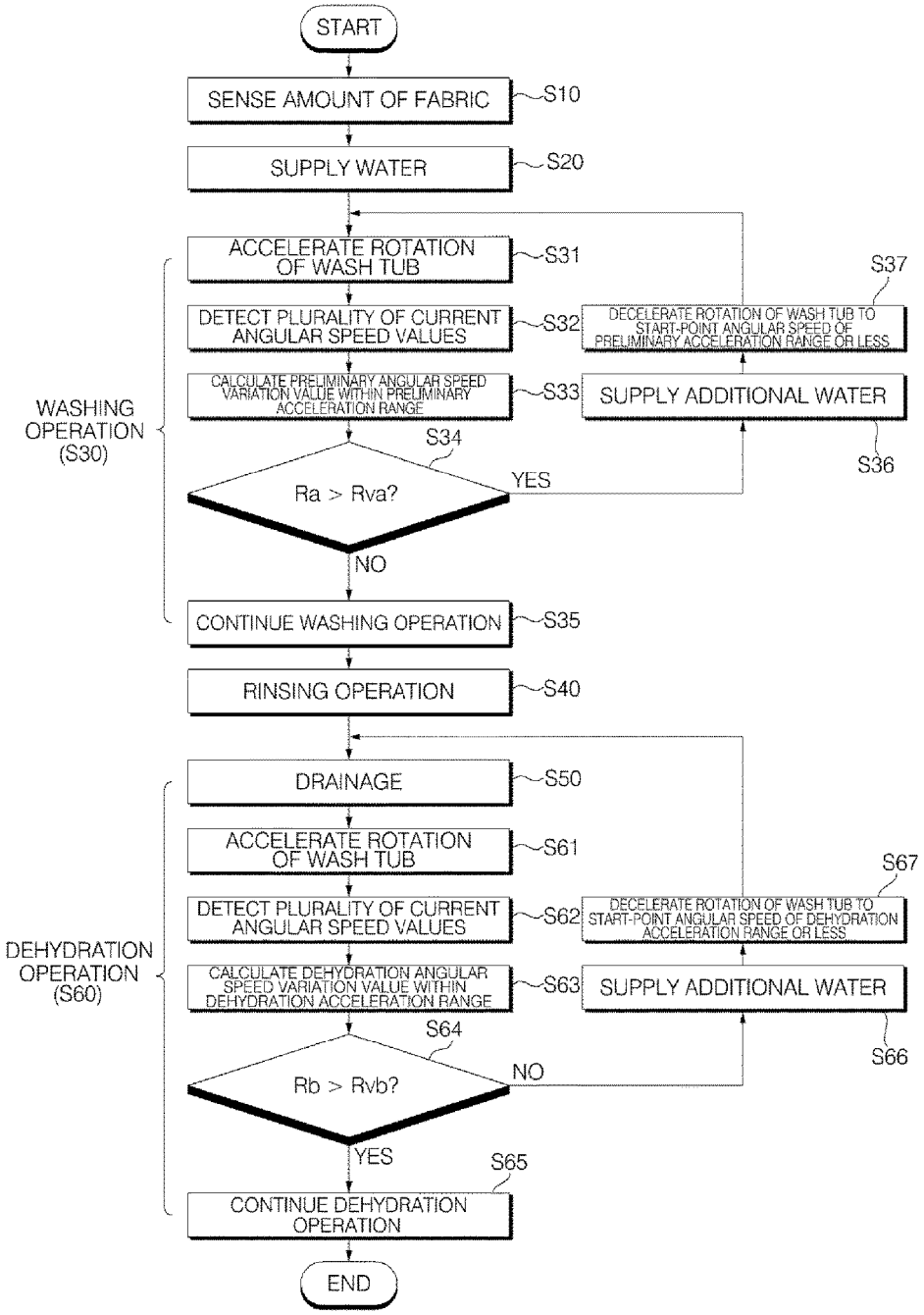
FIG. 7 is a flowchart of a control method in accordance with one embodiment of the present invention.

FIG. 7 is a flowchart of a control method in accordance with one embodiment of the present invention. The flow of the control method and the overall operation in accordance with one embodiment will be described below with reference to FIG. 7.

When fabric is introduced into the wash tub 3 and the overall operation begins, fabric amount sensing S10 is first performed. Although the amount of fabric is sensed in a dry fabric state in the present embodiment, the amount of fabric may be sensed in the state in which fabric has absorbed water and thus is wet in another embodiment. The fabric amount sensing may be performed by accelerating the wash tub 3 to a predetermined angular speed, and thereafter rotating the wash tub 3 at a specific constant angular speed.

Although the preliminary reference variation value Rva and the dehydration reference variation value Rvb are determined regardless of the sensed amount of fabric in the present embodiment of FIG. 7, in another embodiment, the preliminary reference variation value Rva and the dehydration reference variation value Rvb are determined, using the data table, based on the sensed amount of fabric.

After the fabric amount sensing S10, a water supply operation S20 of supplying water to a preset first reference water level into the wash tub 3 is performed. The washing machine may include a water level sensor 23 for sensing the level of water in the water storage tub 2. After the water supply valve 6 is opened, the controller 30 may perform control to close the water supply valve 6 when it is determined that the level of water, which is sensed by the water level sensor 23, reaches the first reference water level.

After the water supply operation S20, a washing operation S30, a rinsing operation S40, a drainage operation S50, and a dehydration operation S60 are performed in sequence.

In the washing operation S30, the wash tub 3 is rotated so that the angular speed of the wash tub 3 is accelerated in the state in which the water is stored in the wash tub 3 (S31). The angular speed detector 47 detects a plurality of current angular speed values $\omega_m$ with a time gap (S32). When the angular speed of the wash tub 3 reaches the start-point angular speed $w_1$,a of the preliminary acceleration range A, the calculation and addition of the above-described absolute values begins. Then, the calculation and addition of the absolute values ends at the point in time at which the angular speed reaches the end-point angular speed $w_2$,a of the preliminary acceleration range A, whereby the preliminary angular speed variation value Ra is calculated (S33).

The magnitude of the calculated preliminary angular speed variation value Ra is compared with the magnitude of the preliminary reference variation value Rva (S34).

When the preliminary angular speed variation value Ra exceeds the preliminary reference variation value Rva, it is estimated that the eccentric rotation degree of the wash tub 3 will exceed a tolerance value in the following dehydration operation S60, and thus a fabric dispersion operation is triggered. And, the dispersion operation is performed. In the present embodiment, fabric dispersion is performed by supplying additional water (S36) and alternately rotating the wash tub or the pulsator in opposite directions. In this case, the accelerating step S31, the detecting step S32 and the calculation step S33 are repeated. The fabric dispersion may be performed by supplying water into the wash tub 3 to a second reference water level, which is higher than the first reference water level. Once the fabric dispersion has been performed, the control method may again begin from the wash tub acceleration rotation operation S31. In addition, the rotation of the wash tub 3 may stop or be slowed for the fabric distribution, and in order to again enter the wash tub acceleration rotation operation S31 after the fabric dispersion, the rotation of the wash tub 3 may be slowed to the start-point angular speed $w_1$,a of the preliminary acceleration range A or less (S37).

When the preliminary angular speed variation value Ra is equal to or less than the preliminary reference variation value Rva, it is estimated that the eccentric rotation degree of the wash tub 3 will not exceed a tolerance value in the dehydration operation S60 that is a subsequent operation, and thus, the washing operation is continued without the fabric dispersion (S35).

After the washing operation S30, the rinsing operation S40 is performed. In another embodiment, the rinsing operation S40 may include an operation of calculating the preliminary angular speed variation value Ra and comparing the magnitude of the same with that of the preliminary reference variation value Rva so as to determine whether or not to perform fabric dispersion. A description thereof is the same as the above description, and thus, is omitted.

After the rising operation S40, the drainage operation S50 is performed. The drainage valve 8 is opened and the drainage pump 10 is operated by the controller 30, such that water inside the water storage tub 2 is discharged outward.

After the drainage operation S50 or when the drainage operation S50 has been performed to some extent, the dehydration operation S60 begins. The dehydration operation S60 may include an operation of calculating the dehydration angular speed variation value Rb and comparing the magnitude of the same with that of the dehydration reference variation value Rvb so as to determine whether or not to trigger fabric dispersion. This serves to prepare for the unlikely case where the estimation of the eccentric rotation degree of the wash tub 3, performed in advance within the preliminary acceleration range A, is incorrect and for the case where the eccentric rotation degree exceeds a tolerance value due to a change in the arrangement of fabric after the estimation operation S34 of estimating the eccentric rotation degree of the wash tub 3.

In the dehydration operation S60, the wash tub 3 is rotated so that the angular speed of the wash tub 3 is accelerated in the state in which the water inside the wash tub 3 is discharged (S61). The angular speed detector 47 detects a plurality of current angular speed values $\omega_m$ with a time gap (S62). When the angular speed of the wash tub 3 reaches the start-point angular speed $w_1$,b of the dehydration acceleration range B, the calculation and addition of the above-described absolute values begins, and the calculation and addition of the absolute values ends at the point in time at which the angular speed reaches the end-point angular speed $w_2$,b of the dehydration acceleration range B, whereby the dehydration angular speed variation value Rb is calculated (S63).

The magnitude of the calculated dehydration angular speed variation value Rb is compared with the magnitude of the dehydration reference variation value Rvb (S64).

When the dehydration angular speed variation value Rb exceeds the dehydration reference variation value Rvb, it is determined that the eccentric rotation degree of the wash tub 3 exceeds a tolerance value in the dehydration operation S60, and a fabric dispersion operation is triggered. In the present embodiment, fabric dispersion is performed by supplying additional water (S66) and alternately rotating the wash tub or the pulsator in opposite directions. In this case, the drainage step S50, the accelerating step S61, the detecting step S62 and the calculation step S63 are repeated. When the fabric dispersion has been performed, the control method may again begin from the wash tub acceleration rotation operation S61. In addition, the rotation of the wash tub 3 may stop or be slowed for fabric dispersion, and in order to again enter the wash tub acceleration rotation operation S61 after the fabric dispersion, the rotation of the wash tub 3 may be slowed to the start-point angular speed $w_1$,b of the dehydration acceleration range B or less.

When the dehydration angular speed variation value Rb is the dehydration reference variation value Rvb or less, it is determined that the eccentric rotation degree of the wash tub 3 does not exceed a tolerance value in the dehydration operation S60. Thus, the dehydration operation is continued without the fabric dispersion (S65).

As is apparent from the above description, the present invention has the following effects.

First, the eccentric rotation degree of a wash tub in a dehydration operation, which is equal to or more than a tolerance value, may be estimated with a high degree of accuracy before the dehydration operation.

Second, the angular speed value of the wash tub may be measured via a motor without a separate vibration detection system, and the eccentric rotation degree of the wash tub may be determined from a converted numerical value of the angular speed value.

Third, the dispersion of fabric is performed without additional water supply or with minimum additional water supply during a washing or rinsing operation in the state in which water is stored in the wash tub, which prevents the excessive eccentric rotation of the wash tub, which is estimated with a high degree of accuracy in the dehydration operation. In this way, water consumption and time delay attributable to additional water supply and additional water drainage may be reduced, and agitation rotation for fabric dispersion is performed in the state in which there is sufficient water, which may reduce the probability of overloading the washing machine.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternatives uses will also be apparent to those skilled in the art.

What is claimed is:

1. A method of controlling a washing machine, the washing machine comprising a water storage tub, a wash tub for accommodating fabric therein, the wash tub being rotatably installed inside the water storage tub, and a motor for rotating the wash tub, the method comprising:

a step (a0) supplying water into the wash tub to a first reference water level;

a step (a1) of accelerating an angular speed of the wash tub by rotating the wash tub with water stored and a drainage valve closed therein in a washing or rinsing operation, after the step (a0), and detecting a plurality of current angular speed values ($\omega_m$) with a time gap within a preset preliminary acceleration range, to calculate a preliminary angular speed variation value (Ra), which is a sum of absolute values of differences between the current angular speed ($\omega_m$) values detected before and after each time gap;

a step (b) of comparing the preliminary angular speed variation value (Ra) with a preset preliminary reference variation value (Rva), and triggering fabric dispersion when the preliminary angular speed variation value (Ra) exceeds the preliminary reference variation value (Rva); and a step (c) of discharging the water inside the wash tub with the drainage valve being opened and rotating the wash tub so that the angular speed of the wash tub is accelerated in a dehydration operation, wherein the preliminary reference variation value (Rva) is preset to the preliminary angular speed variation value (Ra) which is calculated when an eccentric rotation degree of the wash tub is a preset maximum tolerance value of a preset tolerance value, and wherein, in step (b), the water is supplied into the wash tub to a second reference water level which is higher than the first reference water level, in order to perform the fabric dispersion.

2. The method of claim 1, wherein the method is repeated from step (a1) when, in step (b), the preliminary angular speed variation value (Ra) exceeds the preliminary reference variation value (Rva).

3. The method of claim 1, wherein, in step (c), water is supplied into the wash tub so as to perform fabric dispersion when the angular speed of the wash tub is accelerated and exceeds the tolerance value.

4. The method of claim 1, wherein step (c) includes:

a step (c1) of detecting a plurality of the current angular speed values ($\omega_m$) with a time gap within a preset dehydration acceleration range which corresponds to the preliminary acceleration range, to calculate a dehydration angular speed variation value (Rb), which is a sum of absolute values of differences between the current angular speed values ($\omega_m$) detected before and after each time gap; and a step (c2) of comparing the dehydration angular speed variation value (Rb) with a preset dehydration reference variation value (Rvb) which corresponds to the preliminary reference variation value (Rva), and triggering fabric dispersion when the dehydration angular speed variation value (Rb) exceeds the dehydration reference variation value (Rvb).

5. The method of claim 4, further comprising:

sensing an amount of fabric inside the wash tub before step (a1), wherein the preliminary reference variation value (Rva) and the dehydration reference variation value (Rvb) are determined based on the preset tolerance value and the sensed amount of fabric.

6. The method of claim 4, wherein the preliminary acceleration range is preset to a range from 50 RPM to 80 RPM.

7. The method of claim 6, wherein the dehydration acceleration range is preset to a range from 90 RPM to 120 RPM.

8. The method of claim 4, wherein the dehydration acceleration range is preset to a range from 90 RPM to 120 RPM.

9. The method of claim 1, further comprising:

sensing an amount of fabric inside the wash tub before step (a1), wherein the preliminary reference variation value (Rva) is determined based on the preset tolerance value and the sensed amount of fabric.

10. The method of claim 1, wherein the current angular speed values ($\omega_m$) are detected whenever the wash tub is rotated by 15 degrees, and wherein the preliminary acceleration range is preset to a range from 50 RPM to 80 RPM.

11. The method of claim 10, wherein the preliminary reference variation value (Rva) is preset to a range from 700 RPM to 800 RPM.

12. The method of claim 1, wherein the preliminary reference variation value (Rva) is preset to a range from 700 RPM to 800 RPM.

* * * * *